US008393756B2

(12) United States Patent
Yang et al.

(10) Patent No.: US 8,393,756 B2
(45) Date of Patent: Mar. 12, 2013

(54) LIGHT UNIT FOR LED LAMP AND METHOD FOR THE SAME

(75) Inventors: Tsai-Yi Yang, Tainan Hsien (TW); Shu-Hsien Wu, Tainan Hsien (TW); Ching-Wen Wu, Tainan Hsien (TW)

(73) Assignee: Cirocomm Technology Corp., Tainan Hsien (TW)

( * ) Notice: Subject to any disclaimer, the term of this patent is extended or adjusted under 35 U.S.C. 154(b) by 479 days.

(21) Appl. No.: 12/843,870

(22) Filed: Jul. 26, 2010

(65) Prior Publication Data

US 2012/0020093 A1 Jan. 26, 2012

(51) Int. Cl.
*F21S 4/00* (2006.01)

(52) U.S. Cl. ..... 362/249.02; 313/506

(58) Field of Classification Search ..... 362/249.01, 362/249.02, 611, 612; 313/498, 506
See application file for complete search history.

(56) References Cited

U.S. PATENT DOCUMENTS 8,304,660 B2 * 11/2012 Tuan et al. ..... 174/258

* cited by examiner

*Primary Examiner* — Vip Patel
(74) *Attorney, Agent, or Firm* — Chun-Ming Shih; HDLS IPR Services

(57) ABSTRACT

A method for manufacturing a light unit for LED lamp first provides an aluminum substrate, which is surface-treated to form a thin aluminum oxide insulating layer thereon. A circuit board is attached to the insulating layer and includes a through hole to expose part of the insulating layer. An LED die is mounted to the exposed part of the insulating layer, and two bonding wires electrically connect the LED die and the circuit board. A wall is formed on the circuit board to enclose the LED die and the bonding wires. Finally, plastic material is dispensed into the wall to form a lens.

18 Claims, 4 Drawing Sheets

LIGHT UNIT FOR LED LAMP AND METHOD FOR THE SAME

BACKGROUND OF THE INVENTION

1. Field of the Invention

The invention relates to a lamp, and in particular to a light unit for LED lamp and method for the same.

2. Description of Prior Art

Light emitting diode (LED) has gradually replaced the traditional light bulb, due to its small size, lower power consumption and durability, and intensively used in traffic light signal, vehicle direction lights, flashlights, cell phones, lighting and large outdoor billboard.

Currently, many of the LED lamps in the lighting are in the form of LED light units, which are made of LED dies, and these light units are formed by welding LED die on fiberglass or carbon fiber circuit substrate. The LED dies, welded to the circuit substrate, have high power characteristics and inevitably become very high heating sources when they are lighted. The extremely high heating source may affect normal use and life time of the high power LED. Therefore, manufacturers provides a heat dissipation structure on the circuit board to disperse the heating source from high power LED, and thus the high power LED can work normally and has a long life time. However, this will cause that production time and the steps of manufacturing process are increasing, and the structure of light unit may become complicated.

Since the technologies of LED field have a rapid development in recent years, the fiberglass or carbon fiber circuit substrates are replaced by MN substrates in order to overcome these deficiencies. The utilization of MN substrates not only simplifies the structure, but also makes the manufacturing process easier. However, AIN substrates are expensive, and cause an increase in production costs.

SUMMARY OF THE INVENTION

Therefore, the main purpose of the present invention is to solve the above deficiencies of prior art. The present invention provides a light unit for LED lamp and method for the same, which is a simple structure, and the cost of production can be reduced.

To achieve the above purpose, the present invention provides a method for manufacturing a light unit for LED lamp comprising the steps of: providing a aluminum substrate, which is surface-treated to form a thin aluminum oxide insulating layer thereon; preparing a circuit board, which has a through hole thereon, and having two opposite first welding areas on its one surface at the edge of the through hole and plural second welding areas for transmitting positive and negative power sources, and the circuit board having a plurality of recesses at the edge to correspond to the notches; attaching the circuit board to the insulating layer by coating a gel on its another surface to expose part of the aluminum oxide insulating layer; mounting an LED die on the insulating layer; electrically connecting two bonding wires to the LED die and the first welding areas; forming a wall on the section between the first and second welding areas of the circuit board to enclose the LED die and the two bonding wires; and dispensing plastic material into the wall to form a lens.

To achieve the above purpose, the present invention provides a structure of light unit for LED lamp, including an aluminum substrate having a thin aluminum oxide insulating layer thereon, and a plurality of notches at the edge; a circuit board provided on the insulating layer and including a through hole to expose part of the insulating layer, and having two opposite first welding areas at the edge of the through hole and plural second welding areas for transmitting positive and negative power sources, and the circuit board having a plurality of recesses at the edge to correspond to the notches; an LED die mounted to the exposed part of the insulating layer, two bonding wires electrically connecting the LED die and the two first welding areas; a wall formed on the section between the first and second welding areas of the circuit board to enclose the LED die and the bonding wires; and a lens formed inside the wall to enclose the LED die and the bonding wires.

DETAILED DESCRIPTION OF THE INVENTION

A preferred embodiment of the present invention will be described with reference to the drawings.

Figure 1:
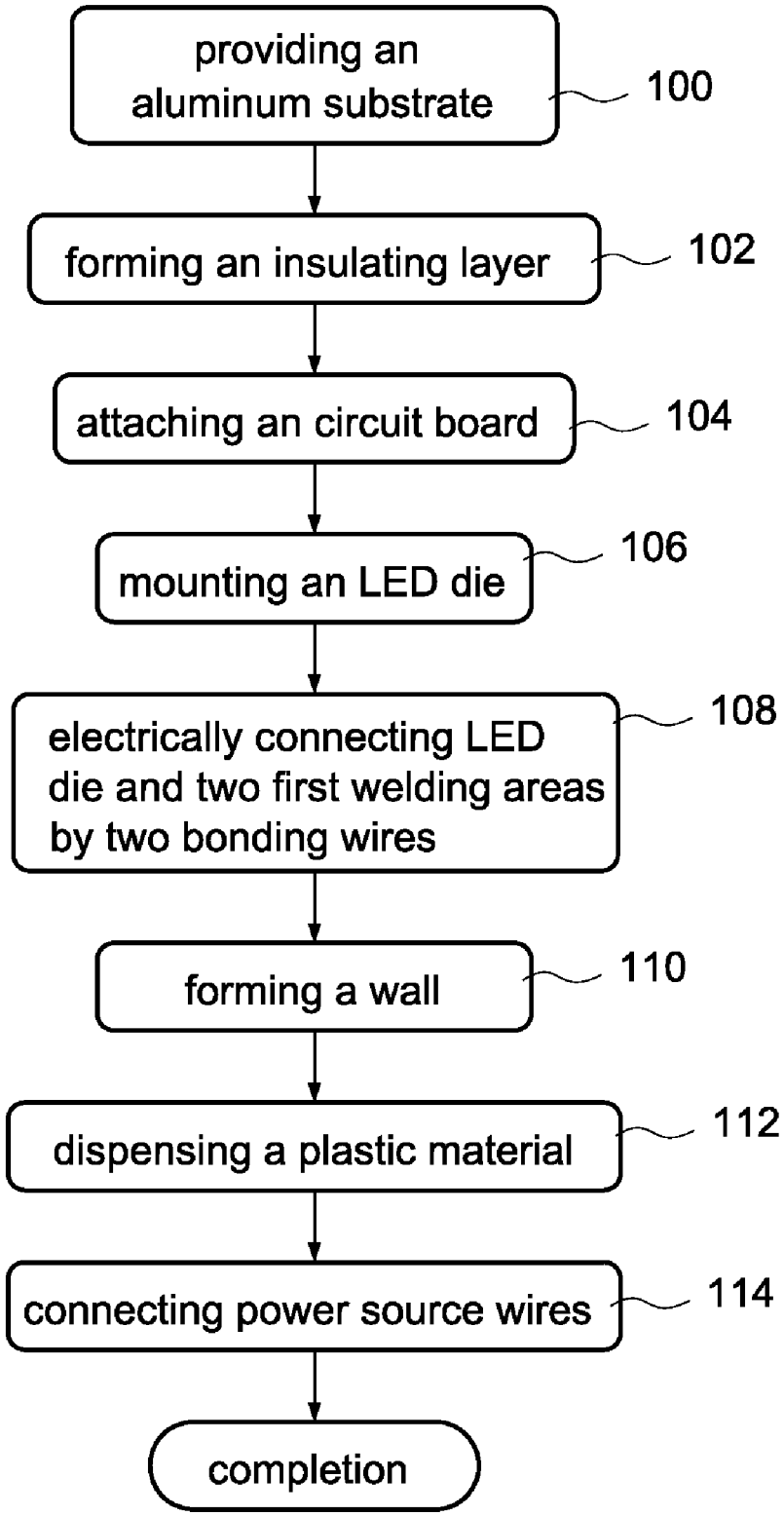
FIG. 1 shows a flow diagram of manufacturing steps according to a preferred embodiment of the present invention.
Figure 2A:
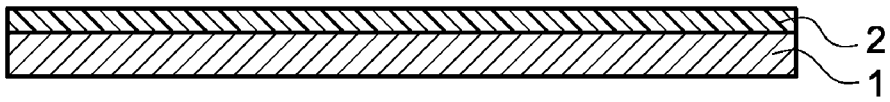
FIGS. 2*a* and 2*c* to 2*g* show schematically drawn step sequential cross section structures obtained in a process according to a preferred embodiment of the present invention.
Figure 2B:
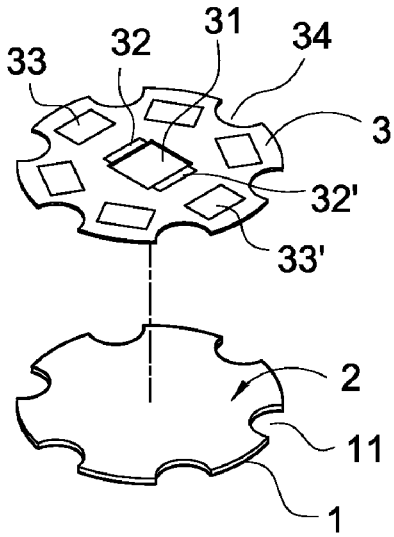
FIG. 2*b* shows an exploded view of FIG. 2*c*.
Figure 2C:
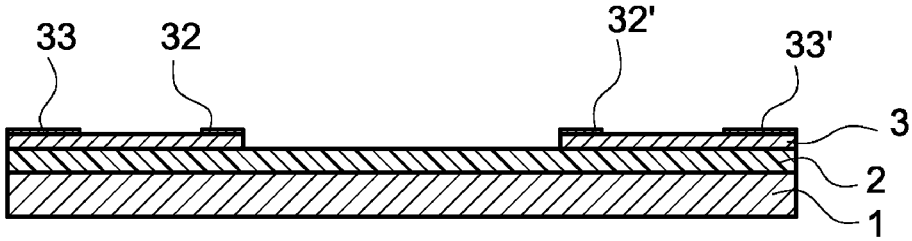
Figure 2D:
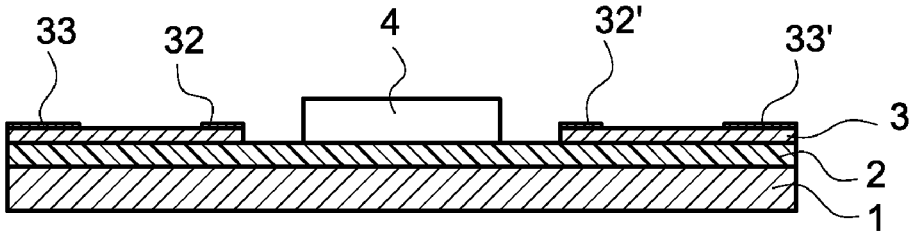
Figure 2E:
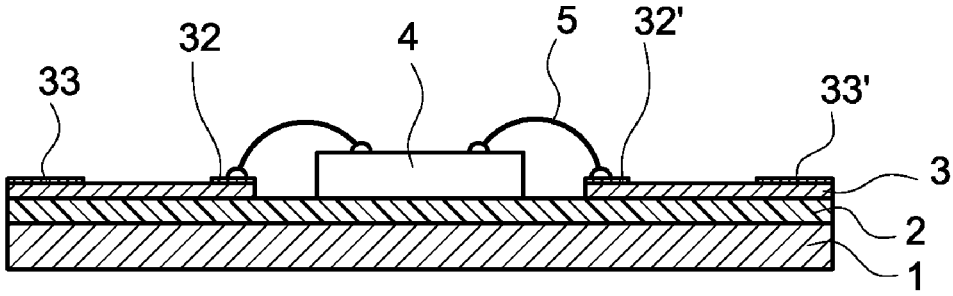
Figure 2F:
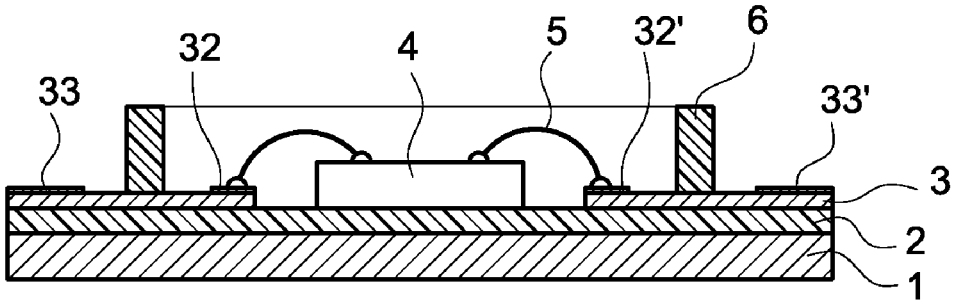
Figure 2G:
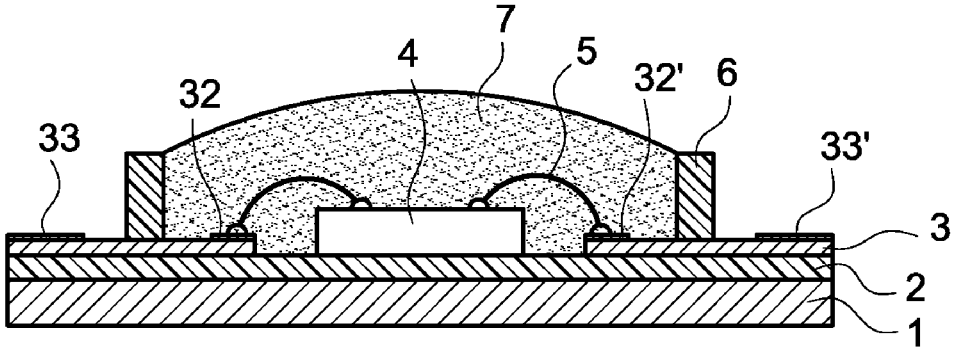
Figure 3:
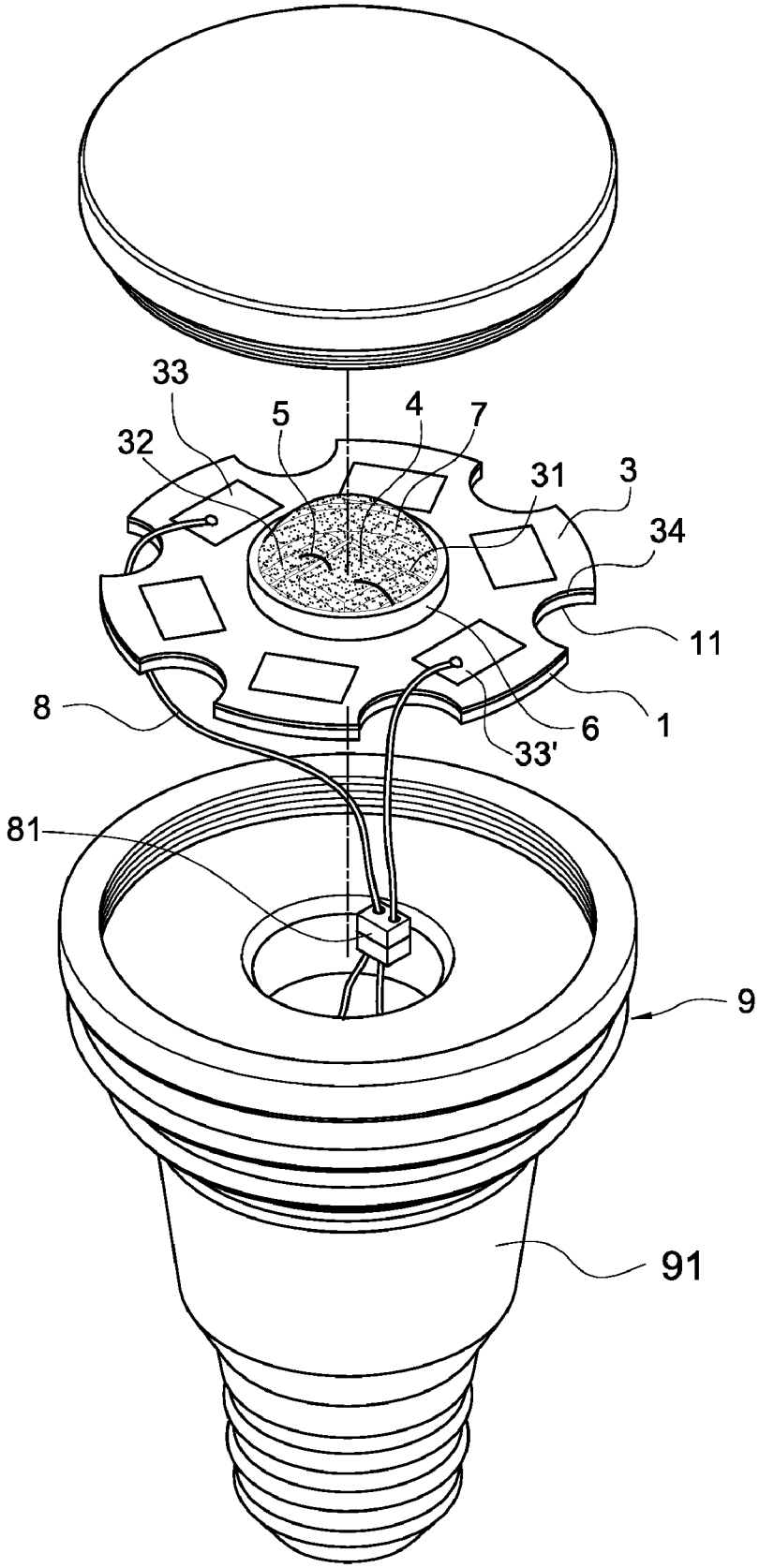
FIG. 3 shows schematically a state of use of light unit for LED lamp according to a preferred embodiment of the present invention.

Please refer to FIGS. 1, 2*a* to 2*g* and 3. FIG. 1 is a process diagram of manufacturing steps according to a preferred embodiment of the present invention. FIGS. 2*a* and 2*c* to 2*g* show schematically drawn step sequential cross section structures obtained in a process according to a preferred embodiment of the present invention. FIG. 2*b* shows an exploded view of FIG. 2*c*. FIG. 3 shows schematically a state of use of light unit for LED lamp according to a preferred embodiment of the present invention. As shown in the drawings, the method for manufacturing a light unit for LED lamp according to the invention first provides an aluminum substrate 1.

In step 102 of forming an insulating layer 2, as shown in FIG. 2*a*, the aluminum substrate 1 is surface-treated to form a thin aluminum oxide insulating layer 2 on its one surface, and a plurality of notches 11 at the edge. The thickness of aluminum oxide insulating layer 2 is 10 μm.

In step 104 of attaching an circuit board 3 to the insulating layer 2, shown as FIGS. 2*b* and 2*c*, the circuit board 3 is a thin slice, which has a through hole 31 thereon in the center, and having two opposite first welding areas 32, 32' on its one surface at the edge of the through hole 31 and plural second welding areas 33, 33' for transmitting positive and negative power sources, and the circuit board having a plurality of recesses 34 at the edge to correspond to the notches 11. In attaching the circuit board 3 to the insulating layer 2, a gel is coated on another surface of the circuit board 3 or on the insulating layer 2, where in former case, the through hole 31 of the circuit board 3 exposes part of the aluminum oxide insulating layer 2, as shown in FIGS. 2*b* and 2*c*. The circuit board 3 is a printed circuit board or a flex printed circuit board.

In step 106 of mounting an LED die 4 on the insulating layer 2, shown as FIG. 2*d*, the LED die 4 is attached to the surface of insulating layer 2 by coating a gel on one surface of the LED die 4 or on the exposed part of the aluminum oxide insulating layer 2 from the through hole 31.

In step 108 of electrically connecting, as shown in FIG. 2*e*, two bonding wires 5 are electrically connected to one surface of the LED die 4 by one end, and electrically connected to the first welding areas 32, 32' by another end.

In step 110 of forming a wall, as shown in FIG. 2*f*, a wall 6 (or in the form of hollow stage) is formed on a surface between the first and second welding areas 32, 32' and 33, 33' of the circuit board 3 by printing. The wall 6 has a predetermined thickness.

In step 112 of dispensing a plastic material, as shown in FIG. 2*g*, a controlled amount of silicone or epoxy resin is dispensed into the wall 6 to form a lens 7. The lens 7 can protect the LED die from damage, and transmit and congregate the outward ray to an object, which is irradiated. The silicone or epoxy resin is doped with phosphor in order to modulate the light color.

In step 114 of connecting power source wires, as shown in FIG. 3, two positive and negative power source wires 8 are electrically connected to any a pair of second welding areas 33, 33', and have a connector 81 at an end thereof.

Please refer to FIG. 2*g*. the present invention provides a structure of light unit for LED lamp, including an aluminum substrate 1 having a thin aluminum oxide insulating layer 2 on its one surface, and a plurality of notches 11 at the edge; a circuit board 3 provided on one surface of the insulating layer 2 and including a through hole 31 to expose part of the insulating layer 2, and having two opposite first welding areas 32, 32' at the edge of the through hole 31 and plural second welding areas 33, 33' for transmitting positive and negative power sources, and the circuit board 3 having a plurality of recesses 34 at the edge to correspond to the notches 11; an LED die 4 mounted to the exposed part of the insulating layer 2 from the through hole 31, two bonding wires 5 electrically connecting the LED die 4 and the two first welding areas 32, 32'; a wall 6 formed on the section between the first and second welding areas 32, 32' and 33, 33' of the circuit board 3 to enclose the LED die 4 and the bonding wires 5; and a lens 7 formed inside the wall 6.

When power is input to the first welding areas 32, 32' through second welding areas 33, 33' from two positive and negative power source wires 8, the LED die 4 is lighted. The ray produced by the LED die 4 is transmitted to outside through the lens 7, and the heating source produced by the LED die 4 is conducted to the aluminum substrate 1 through the insulating layer 2. Accordingly, the heat dissipation is proceeding by the aluminum substrate 1.

The aluminum substrate 1 has the same performance to an expensive MN substrate in the test of heat conductivity of 150 W/mk, since an aluminum oxide insulating layer 2 is formed on the aluminum substrate 1. Therefore, the manufacturing cost can be reduced.

Please refer to FIG. 3. FIG. 3 shows schematically a state of use of light unit for LED lamp according to a preferred embodiment of the present invention. The structure of light unit can be mounted on a lamp 9 with heat dissipation housing 91 to form a LED lamp for used in the lighting.

While the present invention has been described with reference to a preferred embodiment thereof, it shall not be considered as the scope of invention limited thereby. All changes which come within the meaning and range of equivalency of the claims are therefore intended to be embraced therein.

What is claimed is:

1. A light unit for LED lamp comprising:

an aluminum substrate having a thin aluminum oxide insulating layer thereon;

a circuit board provided on the insulating layer and includes a through hole to expose part of the insulating layer;

an LED die mounted to the exposed part of the insulating layer; and two bonding wires electrically connecting the LED die and the circuit board.

2. The light unit of claim 1 wherein the aluminum substrate has a plurality of notches at the edge.

3. The light unit of claim 2 wherein the thickness of insulating layer is 10 μm.

4. The light unit of claim 3 wherein the circuit board is attached to the insulating layer by a gel.

5. The light unit of claim 4 wherein the circuit board is a thin slice, and has two opposite first welding areas at the edge of the through hole and plural second welding areas for transmitting positive and negative power sources; in addition, the second welding areas electrically connect two power source wires, having a connector at an end thereof; and the circuit board has a plurality of recesses at the edge.

6. The light unit of claim 5 wherein a wall is formed on the circuit board to enclose the LED die and the bonding wires between the first and second welding areas.

7. The light unit of claim 6 wherein the circuit board is a printed circuit board or a flex printed circuit board.

8. The light unit of claim 6 wherein silicone or epoxy resin is dispensed into the wall to form a lens, and the silicone or epoxy resin is doped with phosphor in order to modulate the light color.

9. The light unit of claim 4 wherein the LED die is attached to the insulating layer by a gel.

10. A method for manufacturing a light unit for LED lamp comprising the steps of:

(a). providing a aluminum substrate, which is surface-treated to form a thin aluminum oxide insulating layer thereon;

(b). preparing a circuit board, which has a through hole thereon;

(c). attaching the circuit board to the insulating layer to expose part of the insulating layer;

(d). mounting an LED die by one surface to the exposed part of the insulating layer; and (e). electrically connecting two bonding wires to the LED die and the circuit board.

11. The method of claim 10 wherein the aluminum substrate of step (a) has a plurality of notches at the edge.

12. The method of claim 11 wherein the thickness of insulating layer is 10 μm.

13. The method of claim 12 wherein the circuit board is attached to the insulating layer by a gel.

14. The method of claim 13 wherein the circuit board of step (c) is a thin slice, and has two opposite first welding areas at the edge of the through hole and plural second welding areas for transmitting positive and negative power sources; in addition, the second welding areas electrically connect two power source wires, having a connector at an end thereof; and the circuit board has a plurality of recesses at the edge.

15. The method of claim 14 wherein a wall is formed on the circuit board to enclose the LED die and the bonding wires between the first and second welding areas.

16. The method of claim 15 wherein the circuit board is a printed circuit board or a flex printed circuit board.

17. The method of claim 6 wherein silicone or epoxy resin is dispensed into the wall to form a lens, and the silicone or epoxy resin is doped with phosphor in order to modulate the light color.

18. The method of claim 10 wherein the LED die of step (d) is attached to the insulating layer by a gel.

* * * * *